United States Patent [19]

Carocci

[11] 4,271,816

[45] Jun. 9, 1981

[54] FIREPLACE

[75] Inventor: Alberto Carocci, Rome, Italy

[73] Assignee: Racla Co. Limited, St. Helier, Great Britain

[21] Appl. No.: 913,379

[22] Filed: Jun. 7, 1978

[30] Foreign Application Priority Data

Jul. 5, 1977 [IT] Italy ..... 50121 A/77

[51] Int. Cl.[3] ..... F24B 9/04; F24B 1/18

[52] U.S. Cl. ..... 126/132; 126/120; 126/121; 126/133

[58] Field of Search ..... 126/120, 132, 133, 143

[56] References Cited

U.S. PATENT DOCUMENTS

| | | | |
|---|---|---|---|
| 2,622,587 | 12/1952 | Dupler | 126/132 |
| 4,019,677 | 4/1977 | Dotschkal et al. | 126/132 |
| 4,025,043 | 5/1977 | Cleer, Jr. | 126/132 |
| 4,088,113 | 5/1978 | McIntire et al. | 126/132 |
| 4,126,118 | 11/1978 | Hayens | 126/132 |

*Primary Examiner*—Samuel Scott
*Assistant Examiner*—Wesley S. Ratliff, Jr.
*Attorney, Agent, or Firm*—Browdy and Neimark

[57] ABSTRACT

A combination fireplace and boiler, in which the walls of the fireplace furnace and the fireplace hood form a boiler which is connectable with a central heating plant. For this purpose, the furnace walls consist of water jackets and the hood interior forms a water tube or fire tube boiler, communicating with said water jackets.

6 Claims, 6 Drawing Figures

FIREPLACE

BACKGROUND OF INVENTION

The invention pertains to the field of heating systems, and specifically to the field of fireplaces. Fireplaces as a heat source were becoming increasingly obsolete, owing to their comparatively low thermal yield, since most of the heat produced in them escaped through the hood and flue into the open.

Therefore, in modern buildings, they gave way to more rational heating systems, such as central heating, air conditioning or convector plants. Where fireplaces were still installed, their role was mostly restricted to that of a barbecue or of a purely ornamental element, with electric lights shining from under imitation logs to simulate a fire or the glow of embers.

STATEMENT OF INVENTION

It is the object of the invention to provide a fireplace with a very high thermal yield.

It is a further object of the invention to provide a fireplace which, in addition to its ornamental function, also acts as a boiler for a central heating plant or a warm water supply for a whole apartment or house.

To attain these and other objects, in the fireplace according to the invention at least the hood is formed into a boiler, through which the combustion products must flow prior to entering the flue, said boiler being provided with sleeves for its connection to a hot water system, such as a central heating plant. To extend the water containing capacity as well as the heated surfaces of the boiler, the rear and the sides of the fireplace furnace consist of double walls delimiting a water filled cavity or water jacket communicating with the boiler formed by the hood. In this application, the term "furnace" is intended to designate the space provided for burning the fuel. The hood of the fireplace may either be a water tube or a fire tube boiler or a combination of both.

DESCRIPTION OF THE DRAWINGS

For a purely illustrative and in no way limitative purpose two possible embodiments of the invention will now be described with reference to the attached drawings, wherein.

DESCRIPTION OF THE INVENTION

Figure 3:
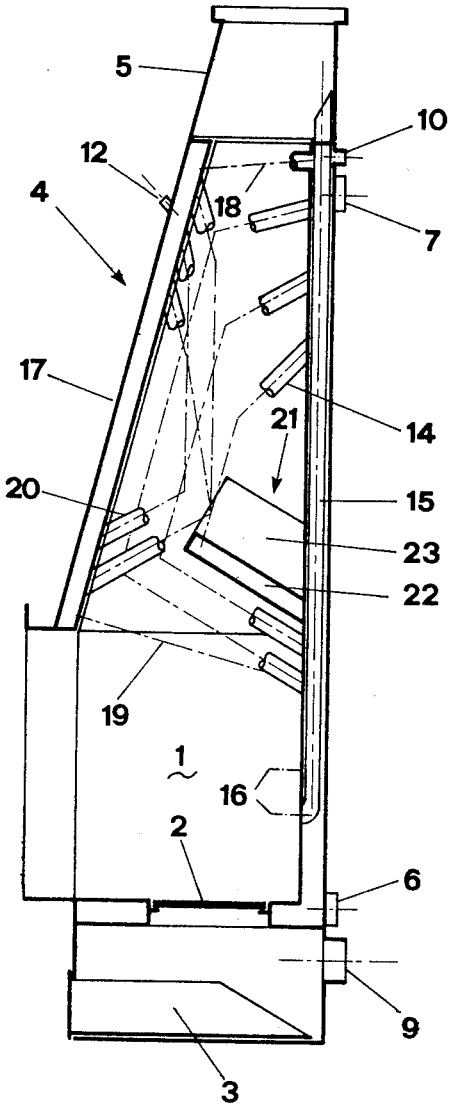
FIG. 3 is a lateral sectional elevation of the fireplace of FIGS. 1 and 2.

The floor, the sides and the back of the furnace 1 and the body of the hood 4 are double walled (see FIG. 3), thereby forming a hollow space or water jacket which practically surrounds the whole fireplace, and forms a reservoir where the water to be heated is contained and circulated.

Figure 1:
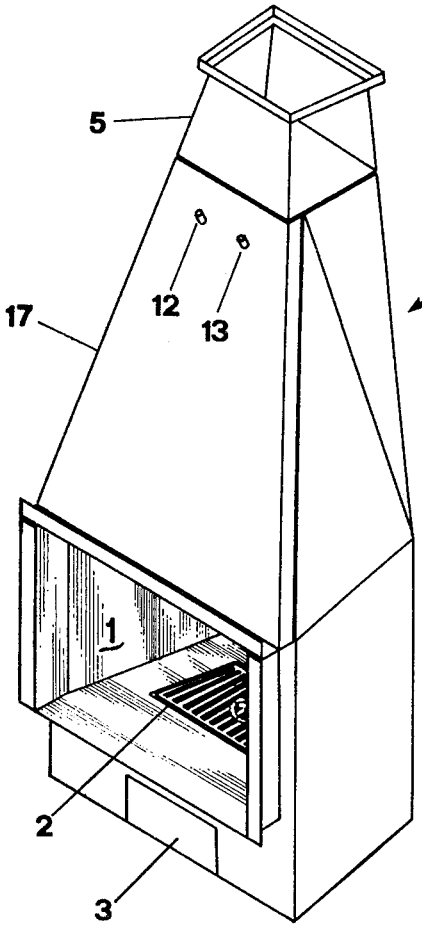
FIG. 1 is a perspective view showing the front and one side of the first embodiment.
Figure 2:
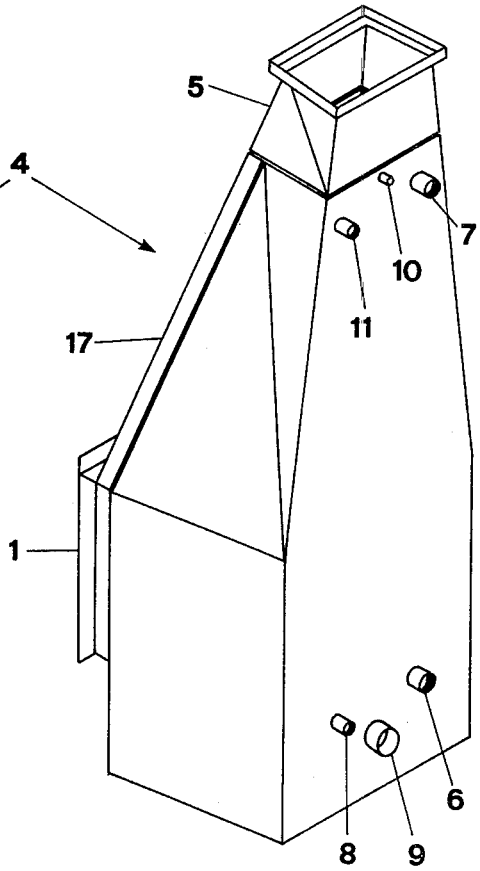
FIG. 2 is a perspective view showing the rear and one side of said embodiment.

The water jacket is connected to a water supply by an inlet 6 and with the hot water system of the house by an outlet 7. It can be emptied through a discharge 8. FIG. 2 shows also an air intake 9 ending below the grate 2 for the entrance of the combustion air, a pipe connection 10 for the connection of the water jacket with a safety pipe terminating into an open (not shown) expansion tank; a tubular recess 11 to receive the sensor of a (not shown) thermostat controlling an (not shown) accoustic alarm in case the temperature of the water in the water jacket reaches a dangerous level.

The top front portion of hood 4 is provided with a tubular recess 12 for the sensor of a pressure gage indicating the water pressure in said jackets, and additionally a tubular recess 13 to receive the sensor of a thermometer indicating the water temperature in said jackets.

A plurality of water tubes 18 are branched inward from the lower terminal portion of the rear water jacket, led within the hood interior along the path of the combustion gases and thence back into the upper end portion of said jacket.

Figure 4:
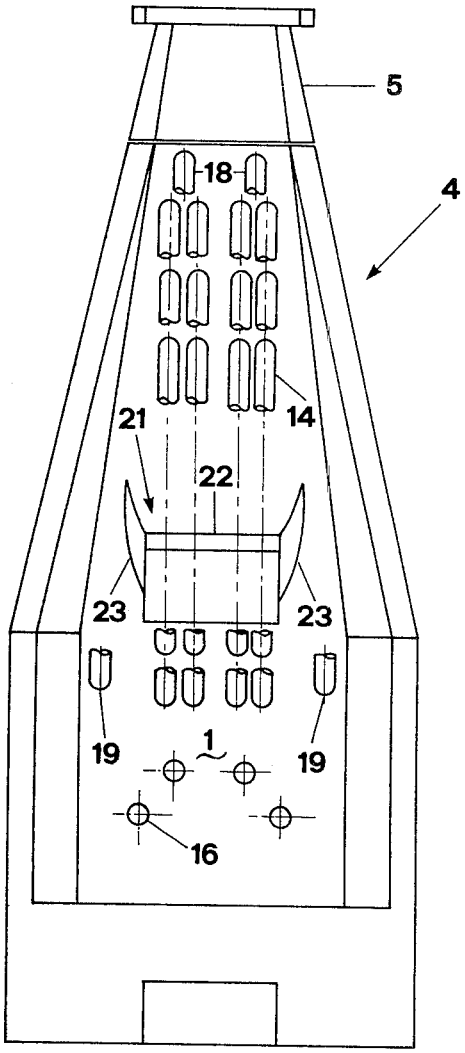
FIG. 4 is a front elevation thereof, with the front portions broken away.

A plurality of fire tubes 1 are passed through the rear and both lateral water jackets (FIG. 3), their inlets 16 being located at furnace level, their outlets in the interior of the transition piece 5. The front jacket 17 of the hood 4 is removable for maintenance purposes. Its interior communicates with the rear water jacket through two upper disconnectable feed pipes 18 and two lower return pipes 19, which are also disconnectable and indicated by dot and dash lines in FIG. 3 and only partially shown in FIG. 4.

Also the front jacket 17 may be provided with a nest of water tubes 20, similarly to the rear jacket, which project into the interior of hood 4.

A baffle, generally indicated with 21, and rigidly connected with the rear wall of hood 4, is provided between the water tubes 14 and so shaped and positioned as to conveniently deflect the upward flow of the combustion gases towards the surfaces of the water tubes 14 and 20.

In the present embodiment, the baffle 21 comprises a box-shaped essentially parallelepipedal component 22 fitted with two lateral, upwardly curved fins 23. The box-haped element 22 communicates with the interior of the rear water jacket and therefore water circulates also in its interior.

A known type and therefore not shown damper is interposed between the hood top and the transition piece 5, to regulate the combustion process.

Figure 5:
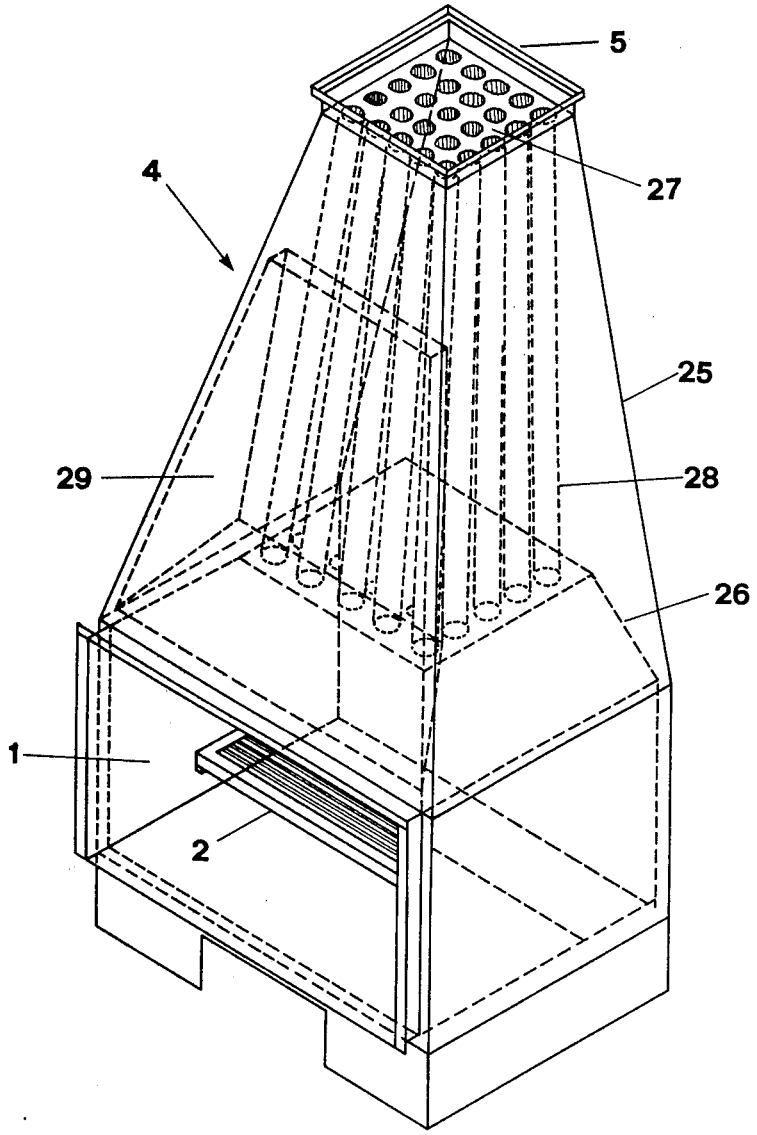
FIG. 5 is a perspective view of the second embodiment.
Figure 6:
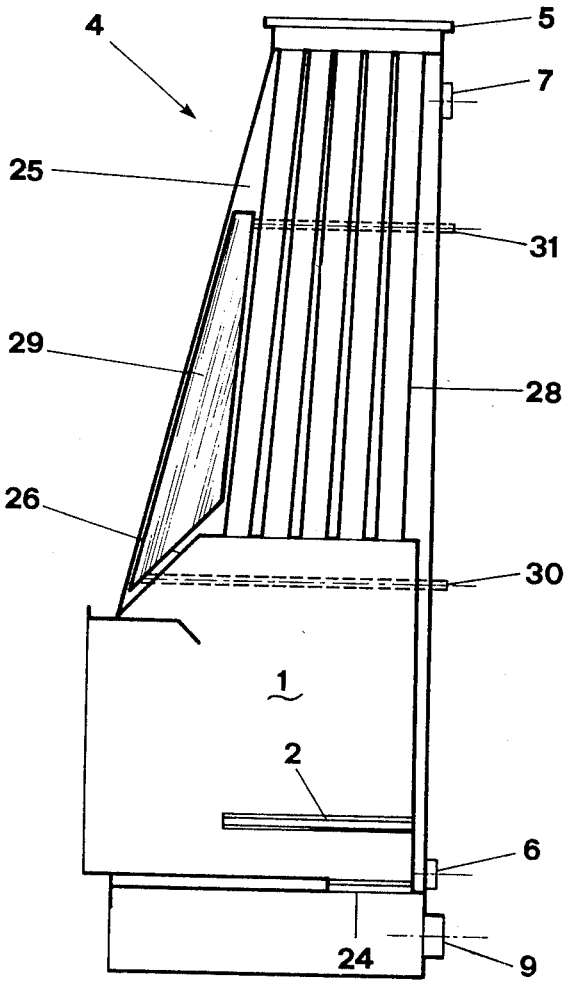
FIG. 6 is a lateral sectional elevation thereof.

The second embodiment is shown in FIGS. 5 and 6, wherein the same or similar components are indicated by the same reference numbers. In this embodiment, the grate 2, on which the fuel is burnt, is positioned at a certain height above the hearth, while a grate-covered opening 24 in the furnace floor serves as a passage for the combustion air from the intake 9 into the furnace.

In this embodiment, only the rear and the two lateral walls of the furnace form a water jacket, while the hood forms a single water tank 25 having a bottom plate 26 and a top plate 27. Tank 25 communicates with the interior of the water jackets of the furnace walls. The bottom plate 26 has an upwards tapering, frustopyramidal shape to convey the combustion gases into the inlets of the vertical fire tube 25 which pass through the boiler. The interior of the boiler communicates with the rear and lateral water jackets of the furnace.

In the interior of tank 25 there may be installed, preferably in the front wall of the hood 4, a separate warm water tank 29 to supply warm water for household uses.

This tank has a water inlet 30 and an outlet 31 on the rear of the hood. Although not particularly shown also this embodiment can be provided with the metering and controll devices described in connection with the first embodiment.

The combined fireplace and boiler according to the invention is capable of reaching very high heat outputs, up to 100.000 Kcal/h and more, owing to the combined effect of its large furnace, wherein great amounts of fuel can be burned, and its extensive and well distributed heating surface exposed to the combustion gases, to yield their heat to the water before it can escape into the atmosphere.

The heat efficiency tests performed on the combination fireplace and burner of different models and heat outputs, up to 100.000 kcal/hour have shown mean values of 80%. In their standard type construction, they are capable of withstanding internal pressures exceeding 2 metric atmospheres, and can therefore be utilized for the central heating of 20–25 meter high buildings.

As it can be easily seen, the exterior of the fireplace can be made to assume not only the shapes here illustrated, but any conformation and aspect created by architects and internal decorators to match the room in which it is to be installed. It is an all-metal construction, whose surfaces can be masked with any suitable material, such as tiles, bricks, etc. Obviously, if the fireplace is intended to serve also a central heating plant, in addition to the feed water connection 6, also a connection with the return line of the heating plant will be provided.

The present invention is not limited to the above described two embodiments, but comprises any variant and change in the shape of its furnace, hood and tube system construction and arrangement.

What is claimed is:

1. A combination fireplace and boiler, the combination comprising a solid fuel burning furnace and a hood, at least the interior of said hood defining a boiler through which combustion gases flow during passages from said solid fuel burning furnace to a fireplace flue, said boiler including a plurality of heat exchange tubes which rise generally vertically inside said hood in a direction substantially parallel with the path of rising combustion gases so as not to encumber draft, said tubes defining substantially vertically extending heat exchange surfaces, and said boiler being provided with compartment means for containing water to be heated and means for its connection to a hot water system, wherein said heat exchange tubes extend from said furnace to substantially the top of said hood and are substantially surrounded by said compartment means for containing water to be heated, wherein said substantially vertical heat exchange surfaces allow effective passage of water, and wherein walls of said hood and of said furnace are double walls defining intercommunicating water jackets wherein water to be heated is to be contained and circulated.

2. A combination according to claim 1, further comprising a plurality of water tubes which are branched inward from lower terminal portions of said water jackets, passed through the interior of said hood along the path of the combustion gases and thence entered back into upper terminal portions of said water jackets.

3. A combination according to claim 1, including a first hood wall, and wherein said front hood wall is removable and is connectable with at least one of said water jackets through pipes.

4. A combination according to claim 1, wherein at least some of said heat exchange tubes extend through said water jackets from the top of said furnace to substantially the top of said hood.

5. A combination according to claim 3, including a nest or bank of water tubes projecting from a front jacket of said hood into the interior of said hood.

6. A combination according to claim 1, further comprising a baffle with a box-shaped element communicating with the interior of one water jacket.

* * * * *